US008353536B2

(12) United States Patent
Andres

(10) Patent No.: US 8,353,536 B2
(45) Date of Patent: Jan. 15, 2013

(54) DOUBLE-SIDED BOOK FOR COMPREHENSION OF SCRIPTURAL TEXTS

(76) Inventor: Kathleen Lemp Andres, Decatur, GA (US)

( * ) Notice: Subject to any disclaimer, the term of this patent is extended or adjusted under 35 U.S.C. 154(b) by 704 days.

(21) Appl. No.: 12/050,163

(22) Filed: Mar. 17, 2008

(65) Prior Publication Data

US 2009/0230668 A1 Sep. 17, 2009

(51) Int. Cl.
*B42D 1/00* (2006.01)
*B42D 3/18* (2006.01)
*B42D 15/00* (2006.01)

(52) U.S. Cl. ..... 281/16; 281/51; 283/63.1; 283/64

(58) Field of Classification Search ..... 281/16, 281/51; 283/63.1, 64
See application file for complete search history.

(56) References Cited

U.S. PATENT DOCUMENTS 1,353,371 A * 9/1920 Winslow ..... 283/63.1
3,758,136 A * 9/1973 Guyer ..... 281/16
4,606,554 A * 8/1986 Lederman ..... 281/51
4,932,679 A * 6/1990 Mayer et al. ..... 281/16
5,626,365 A * 5/1997 Petteway ..... 281/51
6,210,172 B1 * 4/2001 Clements ..... 281/33
2006/0022448 A1 * 2/2006 Bolton ..... 281/16

OTHER PUBLICATIONS

Bishop's Bible (1572) http://www.historicpages.com/texts/lfcat39.htm.*
English/Spanish First Aid Essentials Booklet (Jan. 2008) https://www.instructorscorner.org/ViewLink.aspx?lnk=583.*
Rotherham Version (1872) http://www.bible-researcher.com/rotherham.html.*

* cited by examiner

*Primary Examiner* — Dana Ross
*Assistant Examiner* — Kyle Grabowski
(74) *Attorney, Agent, or Firm* — Handal & Morofsky LLC

(57) ABSTRACT

A flip-book for educating a user is which employs two book components; a first book component and a second book component is described in this invention. An initial portion of the first book component includes a first cover and an initial portion of the second book component includes a second cover. The cover is positioned on the opposite side of the flip-book. The first component and the second component share a book spine. At least one page of ancient religious text is associated with the first book component. At least one page of modern day text is associated with the second book component.

11 Claims, 13 Drawing Sheets

FIG. 7

*The First Book of Moses, called*

Genesis

Chapter 1

In the beginning God created the heaven and the earth.

2 And the earth was without form, and void; and darkness was upon the face of the deep. And the Spirit of God moved upon the face of the waters.

3 And God said, Let there be light: and it was good: and God divided the light from the darkness.

5 And God called the light Day, and the darkness he called Night. And the evening and the morning were the first day.

6 And God said, Let there be a firmament in the midst of the waters, and let it divide the waters from the waters.

7 And God made the firmament, and divided the waters which were under the firmament from the waters which were above the firmament: and it was so.

8 And God called the firmament Heaven. And the evening and the morning were the second day.

9 And God said, Let the waters under the heaven be gathered together unto one place, and let the dry land appear: and it was so.

10 And God called the dry land Earth; and the gathering together of the waters called he Seas: and God saw that it was good.

11 And God said, Let the earth bring forth grass, the herb yielding seed, and the fruit tree yielding fruit after his kind, and the tree yielding fruit, whose seed was in itself, upon the earth, and it was so.

12 After the earth brought forth grass, and herb yielding seed after his kind, and the tree yielding fruit, whose seed was in itself, after his kind: and God saw that it was good.

13 And the evening and the morning were the third day.

14 And God said, Let there be lights in the firmament of the heaven to divide the day from the night; and let them be for signs, and for seasons, and for days, and years.

15 And let them be for lights in the firmament of the heaven to give light upon ght; and let them be for signs, and for seasons, and for days, and years.

16 And God called the firmament Heaven. And the evening and the morning were the second day.

17 And God said, Let the waters under the heaven be gathered together unto one place, and let the dry land appear: and it was so.

18 And God called the dry land Earth; and the gathering together of the waters called he Seas: and God saw that it was good.

19 And God said, Let the earth bring forth grass, the herb yielding seed, and the fruit tree yielding fruit after his kind, and the tree yielding fruit, whose seed was in itself, upon the earth, and it was so.

20 And God said, Let the earth bring forth grass, the herb yielding seed, and the fruit tree yielding fruit after his kind, and the tree yielding fruit, whose seed was in itself, upon the earth, and it was so.

21 After the earth brought forth grass, and herb yielding seed after his kind, and the tree yielding fruit, whose seed was in itself, after his kind: and God saw that it was good.

22 And the evening and the morning were the third day.

23 And God said, Let there be lights in the firmament of the heaven to divide the day from the night; and let them be for signs, and for seasons, and for days, and years.

24 And let them be for lights in the firmament of the heaven to give light upon

Chapter 2

And the earth was without form, and void; and darkness was upon the face of the deep. And the Spirit of God moved upon the face of the waters.

3 And God said, Let there be light: and it was good: and God divided the light from the darkness.

5 And God called the light Day, and the darkness he called Night. And the evening and the morning were the first day.

6 And God said, Let there be a firmament in the midst of the waters, and let it divide the waters from the waters.

7 And God made the firmament, and divided the waters which were under the firmament from the waters which were above the firmament: and it was so.

8 And God called the firmament Heaven. And the evening and the morning were the second day.

9 And God said, Let the waters under the heaven be gathered together unto one place, and let the dry land appear: and it was so.

10 And God called the dry land Earth; and

FIG. 8

The Best Time of My Life

Marilyn Monroe personified Hollywood glamour with an unparalleled glow and energy that enamored the world. Although she was an alluring beauty with voluptuous curves and a generous pout, Marilyn was more than a '50s sex goddess. Her apparent vulnerability and innocence, in combination with an innate sensuality, has endeared her to the global consciousness. She dominated the age of movie stars to become, without question, the most famous woman of the 20th Century.

She was born Norma Jeane Mortenson on June 1, 1926 in Los Angeles, California, to Gladys Baker. As the identity of her father is undetermined, she was later baptized Norma Jeane Baker. Gladys had been a film cutter at RKO studios, but psychological problems prevented her from keeping the job and she was eventually committed to a mental institution.

> *"I knew I belonged to the public and to the world, not because I was talented or even beautiful, but because I had never belonged to anything or*

Norma Jeane spent most of her childhood in foster homes and orphanages until 1937, when she moved in with family friend Grace McKee Goddard. Unfortunately, when Grace's husband was transferred to the East Coast in 1942, the couple couldn't afford to take 16-year-old Norma Jeane with them. Norma Jeane had two options: return to the orphanage or get married.

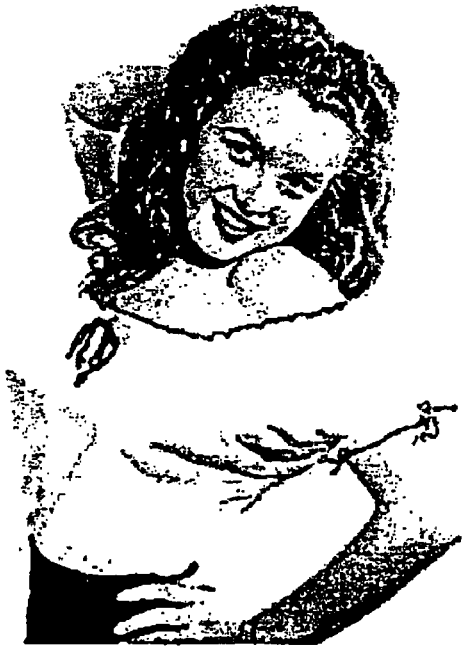

On June 19, 1942 she wed her 21-year-old neighbor Jimmy Dougherty, whom she had been dating for six months. "She was a sweet, generous and religious girl," Jimmy said. "She liked to be cuddled." By all accounts Norma Jeane loved Jimmy, and they were happy together until he joined the Merchant Marines and was sent to the South Pacific in 1944.

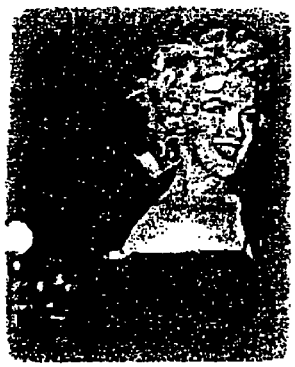

After Jimmy left, Norma Jeane took a job on the assembly line at the Radio Plane Munitions factory in Burbank, California. Several months later, photographer David Conover saw her while taking pictures of women contributing to the war effort for Yank magazine. He couldn't believe his luck. She was a "photographer's dream." Conover used her for the shoot and then began sending modeling jobs her way. The camera loved Norma Jeane, and within two years she was a reputable model with many popular magazine covers to her credit. She began studying the work of legendary actresses Jean Harlow and Lana Turner, and enrolled in drama classes with dreams of stardom. However, Jimmy's return in 1946 meant Norma Jeane had to make another choice-this time between her marriage and her career.

Norma Jeane divorced Jimmy in June of 1946, and signed her first studio contract

FIG. 9

*The First Book of Moses, called*

Genesis

Chapter 1

In the beginning God created the heaven and the earth.

2 And the earth was without form, and void; and darkness was upon the face of the deep. And the Spirit of God moved upon the face of the waters.

3 And God said, Let there be light: and it was good: and God divided the light from the darkness.

5 And God called the light Day, and the darkness he called Night. And the evening and the morning were the first day.

6 And God said, Let there be a firmament in the midst of the waters, and let it divide the waters from the waters.

7 And God made the firmament, and divided the waters which were under the firmament from the waters which were above the firmament: and it was so.

8 And God called the firmament Heaven. And the evening and the morning were the second day.

9 And God said, Let the waters under the heaven be gathered together unto one place, and let the dry land appear: and it was so.

10 And God called the dry land Earth; and the gathering together of the waters called he Seas: and God saw that it was good.

11 And God said, Let the earth bring forth grass, the herb yielding seed, and the fruit tree yielding fruit after his kind, and the tree yielding fruit, whose seed was in itself, upon the earth, and it was so.

12 After the earth brought forth grass, and herb yielding seed after his kind, and the tree yielding fruit, whose seed was in itself, after his kind: and God saw that it was good.

13 And the evening and the morning were the third day.

14 And God said, Let there be lights in the firmament of the heaven to divide the day from the night; and let them be for signs, and for seasons, and for days, and years.

15 And let them be for lights in the firmament of the heaven to give light upon ght; and let them be for signs, and for seasons, and

The Best Time of My Life

Marilyn Monroe personified Hollywood glamour with an unparalleled glow and energy that enamored the world. Although she was an alluring beauty with voluptuous curves and a generous pout, Marilyn was more than a '50s sex goddess. Her apparent vulnerability and innocence, in combination with an innate sensuality, has endeared her to the global consciousness. She dominated the age of movie stars to become, without question, the most famous woman of the 20th Century.

She was born Norma Jeane Mortenson on June 1, 1926 in Los Angeles, California, to Gladys Baker. As the identity of her father is undetermined, she was later baptized Norma Jeane Baker. Gladys had been a film cutter at RKO studios, but psychological problems prevented her from keeping the job and she was eventually committed to a mental institution.

Norma Jeane spent most of her childhood in foster homes and orphanages until 1937, when she moved in with family friend Grace McKee Goddard. Unfortunately, when Grace's husband was transferred to the East Coast in 1942, the couple couldn't afford to take 16-year-old Norma Jeane with them. Norma Jeane had two options: return to

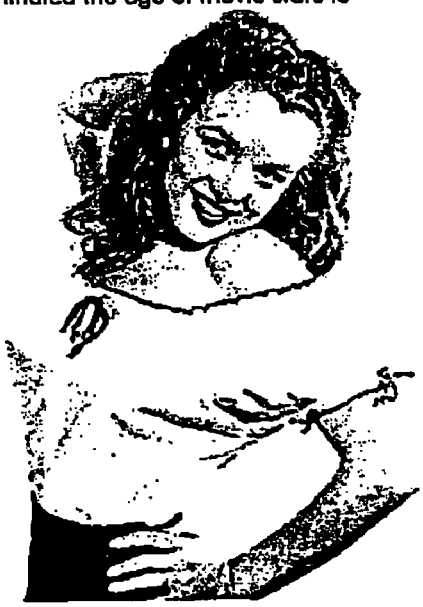

FIG. 10

GENESIS 2 3

18 And God said, Let the earth bring forth grass, the herb yielding seed, and the fruit tree yielding fruit after his kind, and the tree yielding fruit, whose seed was in itself, upon the earth, and it was so.

19 After the earth brought forth grass, and herb yielding seed after his kind, and the tree yielding fruit, whose seed was in itself, after his kind: and God saw that it was good.

20 And the evening and the morning were the third day.

21 And God said, Let there be lights in the firmament of the heaven to divide the day from the night; and let them be for signs, and for seasons, and for days, and years.

22 And let them be for lights in the firmament of the heaven to give light upon.

CHAPTER 2

And the earth was without form, and void; and darkness was upon the face of the deep. And the Spirit of God moved upon the face of the waters.

3 And God said, Let there be light: and it was good: and God divided the light from the darkness.

5 And God called the light Day, and the darkness he called Night. And the evening and the morning were the first day.

6 And God said, Let there be a firmament in the midst of the waters, and let it divide the waters from the waters.

7 And God made the firmament, and divided the waters which were under the firmament from the waters which were above the firmament: and it was so.

8 And God called the firmament Heaven. And the evening and the morning were the second day.

9 And God said, Let the waters under the heaven be gathered together unto one place, and let the dry land appear: and it was so.

10 And God called the dry land Earth; and the gathering together of the waters called he Seas: and God saw that it was good.

11 And God said, Let the earth bring forth grass, the herb yielding seed, and the fruit tree yielding fruit after his kind, and the tree yielding fruit, whose seed was in itself, upon the earth, and it was so.

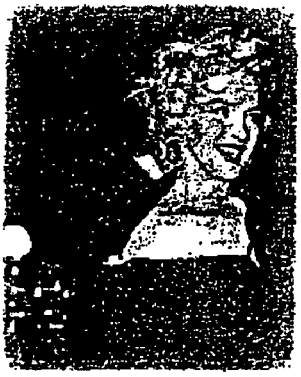

the orphanage or get married.

On June 19, 1942 she wed her 21-year-old neighbor Jimmy Dougherty, whom she had been dating for six months. "She was a sweet, generous and religious girl," Jimmy said. "She liked to be cuddled." By all accounts Norma Jeane loved Jimmy, and they were happy together until he joined the Merchant Marines and was sent to the South Pacific in 1944.

After Jimmy left, Norma Jeane took a job on the assembly line at the Radio Plane Munitions factory in Burbank, California. Several months later, photographer David Conover saw her while taking pictures of women contributing to the war effort for Yank magazine. He couldn't believe his luck. She was a "photographer's dream." Conover used her for the shoot and then began sending modeling jobs her way. The camera loved Norma Jeane, and within two years she was a reputable model with many popular magazine covers to her credit. She began studying the work of legendary actresses Jean Harlow

*"I knew I belonged to the public and to the world, not because I was talented or even beautiful, but because I had never belonged to anything or anyone else."* and Lana Turner, and enrolled in drama classes with dreams of stardom. However, Jimmy's return in 1946 meant Norma Jeane had to make another choice- this time between her marriage and her career.

128

Chapter One

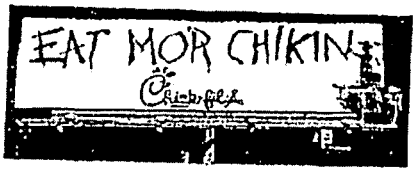

134

Unexpected Opportunities

118

Put two Cows on a billboard with a bucket of paint and a brush, and they'll create some unexpected opportunities. In 1995 we gave the Cows responsibility for taking the message of Chick-fil-A to the public. From their perch high above the highway, and now on radio and television, they remind people in their unique style to "Eat Mor Chikin!" The Cows still haven't learned to spell, and their grammar leaves a lot to be desired, but the opportunities are real. Five years after they painted their first billboard, Chick-fil-A had doubled our sales volume, achieving annual sales of more than $1 billion.

The lesson from the Cows is the lesson of my life: Take advantage of unexpected opportunities.[1] 132

130

We had not planned a major billboard campaign, but the Cows created so much buzz when they appeared, we realized they were presenting a special opportunity to increase awareness of Chick-fil-A and have fun at the same time.

The history of Chick-fil-A, in fact, is a series of unexpected opportunities. When we responded to them, we often found ourselves richly blessed.

The Chick-fil-A Chicken Sandwich itself was born in the wake of an unexpected opportunity. When one of my first two restaurants burned to the ground, I found myself with time on my hands and the availability to develop a new recipe.

*Above: The Chick-fil-A Cows have created tremendous awareness for us and at the same time led to unexpected opportunities.*

[1] *Opportunity.* Mark 13:32-37. But of that day and that hour knoweth no man, no, not the angels which are in heaven, neither the Son, but the Father. Take ye heed, watch and pray: for ye know not when the time is. For the Son of Man is as a man taking a far journey, who left his house, and gave authority to his servants, and to every man his work, and commanded the porter to watch. Watch ye therefore: for ye know not when the master of the house cometh, at even, or at midnight, or at the cockerowing, or in the morning: Lest coming suddenly he find you sleeping. And what I say unto you I say unto all, Watch. [refer to page 869]

136

Fig 15 man coming in the clouds with great power and glory.

27 And then shall he send his angels, and shall gather together his elect from the four winds, from the uttermost part of the earth to the uttermost part of heaven.

28 Now learn a parable of the fig tree; When her branch is yet tender, and putteth forth leaves, ye know that summer is near:

29 So ye in like manner, when ye shall see these things come to pass, know that it is nigh, *even* at the doors.

30 Verily I say unto you, that this generation shall not pass, till all these things be done.

31 Heaven and earth shall pass away: but my words shall not pass away.

32 But of that day and *that* hour knoweth no man, no, not the angels which are in heaven, neither the Son, but the Father.

33 Take ye heed, watch and pray: for ye know not when the time is.

34 *For the Son of man is* as a man taking a far journey, who left his house, and gave authority to his servants, and to every man his work, and commanded the porter to watch.

35 Watch ye therefore: for ye know not when the master of the house cometh, at even, or at midnight, or at the cockerowing, or in the morning:

36 Lest coming suddenly he find you sleeping.

37 And what I say unto you I say unto all, Watch.

CHAPTER 14

AFTER two days was *the feast of* the passover, and of unleavened bread: and the chief priests and the scribes sought how they might take him by craft, and put *him* to death.

2 But they said, Not on the feast *day*, lest there be an uproar of the people.

3 And being in Bethany in the house of Simon the leper, as he sat at meat, there came a woman having an alabaster box of ointment of spikenard very precious; and she brake the box, and poured *it* on his head.

4 And there were some that had indignation within themselves, and said, Why was this waste of the ointment made?

5 For it might have been sold for more than three hundred pence, and have been given to the poor. And they murmured against her 6 And Jesus said, Let her alone; why trouble ye her? she hath wrought a good work on me.

7 For ye have the poor with you always, and whensoever ye will ye may do them good: but me ye have not always.

8 She hath done what she could: she is come aforehand to anoint my body to the burying.

9 Verily I say unto you, Wheresoever this gospel shall be preached throughout the whole world, this also that she hath done shall be spoken of for a memorial of her.

10 And Judas Iscariot, one of the twelve, went unto the chief priests, to betray him unto them.

11 And when they heard *it*, they were glad, and promised to give him money. And he sought how he might conveniently betray him.

12 And the first day of unleavened bread, when they killed the passover, his disciples said unto him, Where wilt thou that we go and prepare that thou mayest eat the passover?

13 And he sendeth forth two of his disciples, and saith unto them, Go ye into the city, and there shall meet you a man bearing a pitcher of water: follow him.

14 And wheresoever he shall go in, say ye to the goodman of the house, The Master saith, Where is the guestchamber, where I shall eat the passover with my disciples?

15 And he will shew you a large upper room furnished *and* prepared: there make ready for us.

16 And his disciples went forth, and came into the city, and found as he had said unto them: and they made ready the passover.

17 And in the evening he cometh with the twelve.

18 And as they sat and did eat, Jesus said, Verily I say unto you, One of you which eateth with me shall betray me.

19 And they began to be sorrowful, and to say unto him one by one, *Is* it I? and another *said, Is* it I?

20 And he answered and said unto them, *It is* one of the twelve, that dippeth with me in the dish.

21 The Son of man indeed goeth, as it is written of him: but woe to that man by whom the Son of man is betrayed! good were it for that man if he had never been born.

22 And as they did eat, Jesus took bread, and blessed, and brake *it*, and

Fig 16

*Chapter*
One

216 222

Hafid lingered before the bronze mirror and studied his reflected image in the polished metal.

"Only the eyes have retained their youth," he murmured as he turned away and moved slowly across the spacious marble floor. He passed between the black onyx columns rising to support ceilings burnished with silver and gold and his aging legs carried him past tables carved from cyprus and ivory.

Tortoise shell gleamed from couches and divans and the walls, inlaid with gems, shimmered with brocades of the most painstaking design. Huge palms grew placidly in bronze vessels framing, a fountain of alabaster nymphs while flower boxes, encrusted with gems, competed with their contents for attention. No visitor to Hafid's palace could doubt that he was, indeed, a person of great wealth.

The old man passed through an enclosed garden and entered his warehouse which extended beyond the mansion for five hundred-paces. Erasmus, his chief bookkeeper, waited uncertainly just beyond the entryway.

"Greetings, sire."

224

Hafid nodded and continued on in silence. Erasmus followed, his face unable to disguise concern at the master's unusual request for a meeting in this place. Near the loading platforms Hafid paused to watch goods being removed from baggage wagons and counted into separate stalls.

There were wools, fine linens, parchment, honey, carpets, and oil from Asia Minor; glass, figs, nuts, and balsam from his own country; textiles and drugs from Palmyra; ginger, cinnamon, and precious stones from Arabia; corn, paper, granite, alabaster, and basalt from Egypt; tapestries from Babylon; paintings from Rome; and statues from Greece. The smell of balsam was heavy in the air and Hafid's sensitive old nose detected the presence of sweet plums, apples, cheese, and ginger.

Finally he turned to Erasmus. "Old friend, how much wealth is there now accumulated in our treasury?" [1]

220 218

Erasmus paled. "Everything, master?" "Everything."

"I have not studied the numbers recently but I would estimate there is in excess of seven million gold talents."

"And were all the goods in all my warehouses and emporiums converted into gold, how much would they bring?"

"Our inventory is not yet complete for this season, sire, but I would calculate a minimum of another three million talents."

Hafid nodded, "Purchase no more goods. Institute immediately whatever plans are required to sell everything that is mine and convert all of it to gold." [2]

[1] *Sell Off*
Isaiah 43:1-4 When You're Between a Rock and a Hard Place But now, God's Message, the God who made you in the first place, Jacob, the One who got you started, Israel: "Don't be afraid, I've redeemed you. I've called your name. You're mine. When you're in over your head, I'll be there with you. When you're in rough waters, you will not go down. When you're between a rock and a hard place, it won't be a dead end— Because I am God, your personal God, The Holy of Israel, your Savior. I paid a huge price for you: all of Egypt, with rich Cush and Seba thrown in! That's how much you mean to me! That's how much I love you! I'd sell off the whole world to get you back, trade the creation just for you. [refer to page 980].

[2] *Purchase No More Goods*
Ecclesiastes 11:1-3 Be generous: invest in acts of charity. Charity yields high returns. 2 Don't hoard your goods; spread them around. Be a blessing to others. This could be your last night 3-4 When the clouds are full of water, it rains. When the wind blows down a tree, it lies where it falls. Don't sit there watching the wind. Do your own work. Don't stare at the clouds. Get on with your life. [refer to page 985]

Fig. 19 blind as a bat — willfully blind!
You've seen a lot, but looked at nothing.
You've heard everything, but listened to nothing.
God intended, out of the goodness of his heart,
to be lavish in his revelation.
But this is a people battered and cowed,
shut up in attics and closets,
Victims licking their wounds,
feeling ignored, abandoned.
But is anyone out there listening?
Is anyone paying attention to what's coming?
Who do you think turned Jacob over to the thugs,
let loose the robbers on Israel?
Wasn't it God himself, this God against whom we've sinned —
not doing what he commanded,
not listening to what he said?
Isn't it God's anger that's behind all this,
God's punishing power?
Their whole world collapsed but they still didn't get it:
their life is in ruins but they don't take it to heart.

When You're Between a Rock and a Hard Place 1-4 But now, God's Message,
the God who made you in the first place, Jacob,
the One who got you started, Israel:
"Don't be afraid, I've redeemed you.
I've called your name. You're mine.
When you're in over your head, I'll be there with you.
When you're in rough waters, you will not go down.
When you're between a rock and a hard place,
it won't be a dead end —
Because I am God, your personal God,
The Holy of Israel, your Savior.
I paid a huge price for you:
all of Egypt, with rich Cush and Seba thrown in!
*That's* how much you mean to me!
*That's* how much I love you!
I'd sell off the whole world to get you back,
trade the creation just for you.

5-7 "So don't be afraid: I'm with you.
I'll round up all your scattered children,
pull them in from east and west.
I'll send orders north and south:
'Send them back.'
Return my sons from distant lands,
my daughters from faraway places,
I want them back, every last one who bears my name,
every man, woman, and child
Whom I created for my glory,
yes, personally formed and made each one.'"

Fig. 20

DOUBLE-SIDED BOOK FOR COMPREHENSION OF SCRIPTURAL TEXTS

FIELD OF THE INVENTION

The invention relates to devices and methods for teaching ethical and religious values through a combination of both scriptural and foundational texts and biographical non-fiction stories which exemplify the principles those works attempt to instill.

BACKGROUND OF THE INVENTION

The fundamentals of all major religions are the foundational religious texts that comprise the body of literature and song associated with their development. These texts contain the principles, values, and beliefs each religion wishes to instill in its followers. Since most of them date centuries or even millennia back in time they often require translation or adaptation to modern times.

Throughout the ages, religious leaders have sought to have the foundational religious texts associated with their religion become relevant to modern society by updating their scriptures with new translations. The intent of these rewritten, updated translations was to bear relevance to worshipers, be contemporary to their times, make more apparent the meaning of time honored foundational religious texts, and allow the religion's followers to have a personal understanding of scripture.

Creating new translations, protected under copyright law, is the manner in which religious leaders have sought to provide religious followers closer comprehension of foundational religious texts. By having multiple translations available for followers to read and choose from, the opportunity for deeper understanding of scriptures increases. The personal understanding and adaptation of foundational religious texts is the challenge of religious leaders worldwide. However, bringing forth understanding and relevance of these scriptures about God through a translation and into an individual's own personal life, has long been the challenge for those involved in religious ministry.

Religion is often defined as a personal or institutionalized system grounded in certain beliefs and worship. In addition, religion is often affiliated with a church, temple, synagogue or other place where people come together to worship. Yet, when polled today, many faithful church-goers and other religious worshipers admit that while they may attend their place of worship regularly, they possess no personal relationship with God. Even more, they often do not know how to identify God working in their lives.

Christianity represents the largest major religion in the world with over 2.1 billion believers. The Islamic religion represents approximately 1.3 billion followers. In addition, non-religious people form the third largest group at approximately 1.1 billion. Non-religious people may claim no religious affiliation, however, they may possess their own personal spiritual or non-spiritual paths.

Anne Graham Lutz—Billy Graham's daughter—has shared that she preaches to those individuals who attend church every time the door is open, but who have no personal relationship with God. While this may sound unusual, studies have shown this mindset to be far more frequent than previously recognized, as Ms. Graham-Lutz acknowledges.

Moreover, in George Barna's latest book *Revolution*, his research shows time and again that individuals are searching for and acquiring a "close personal relationship with God". Many of these same individuals may possess no organized religious affiliation. This means that they may not attend organized religious services. Mr. Barna has named this group of non-organized religion individuals, Revolutionaries. These Revolutionaries are positioned to greatly change and impact Christian and other worship groups more than any other movement has during the past 100 years. The result of this revolution is that organized churches and places of worship, associated with a variety of religions, are seeing their membership stagnate or decline. If this trend continues, it will greatly impact the fiscal future of organized religions. Moreover, he impact on society of such groups may be difficult to predict, as they do not represent an evolution from developed and proven ethical systems.

Despite the stagnation in formal traditional religions and decline in formal places of worship, the number of individuals who claim to have a close personal relationship with God is growing by leaps and bounds. Revolutionaries are tithing to causes they believe in, they believe in sharing with those less fortunate, and simultaneously they are helping to shape religious-thought processes. These attitudes represent a major shift in spiritual thoughts for a diverse number of religions throughout the world.

SUMMARY OF THE INVENTION

A flip-book for educating a user comprises a first book component with a first cover comprising an initial portion of said first book component. A second book component includes a second cover forming an initial portion of said second component of said book. The cover is positioned on the opposite side of the flip-book. A book spine is shared by said first and second book components. At least one page of ancient religious text is associated with said first book component. At least one page of modern day text is associated with the second book component. The first cover may be oriented at an angle different from the angle of orientation of said second cover by about 180 degrees. The first cover may alternatively be oriented at an angle different from the angle of orientation of said second cover by about 90 degrees. The at least one page of modern day text may comprise a primary text and a secondary text. The secondary text may be excerpted in whole or in part from the first book. The primary text may have a printed indicia of a particular content and the secondary text may have a content associated with the particular content. The primary text may have a note indicator and the secondary text may have a note identifier. The note indicator may comprise a footnote indicator and the note identifier may comprise a footnote identifier.

BRIEF DESCRIPTION OF THE DRAWINGS

FIG. 7 is an example of a page from an embodiment of the present invention;

FIG. 8 is another example of a page from an embodiment of the present invention;

FIG. 9 is yet another example of a page from an embodiment of the present invention;

FIG. 10 is still another example of a page from an embodiment of the present invention;

FIG. 15 is a view of a page in the biographical section of the book illustrated in FIG. 11;

FIG. 16 is a view of a page in the religious section of the book illustrated it FIG. 11; and FIGS. 17-20 illustrated still yet another alternative embodiment of the invention.

DETAILED DESCRIPTION OF EMBODIMENTS OF THE INVENTION

Figure 2:
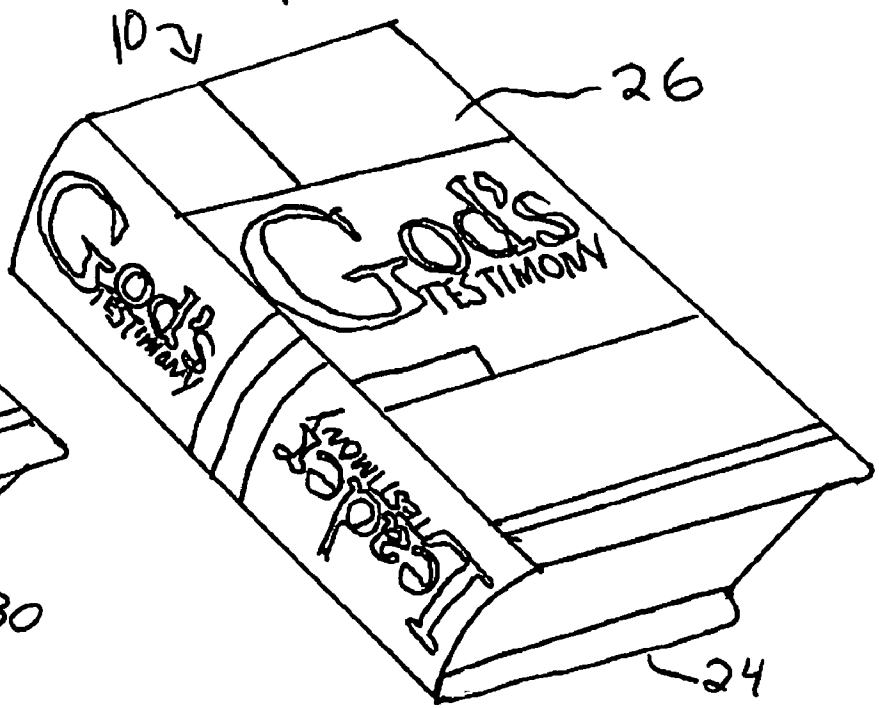
FIG. 2 is another example of an embodiment of the present invention.

People attend a church, temple, mosque, or other place of organized religion for a variety of reasons. Many seek to gain greater knowledge of the religion and its doctrines, some may seek fellowship with likeminded individuals, some may want to be involved in charity work, and some may hope to understand who God is and how to identify God working in their life. It is the responsibility of the leadership of the religious group to utilize their foundational religious texts to bring scriptural and spiritual understanding to their followers.

While the growing trend is for individuals not to attend organized religious services, religious leaders are searching for methods to reach-out and witness to potential worshipers. The objective is for those "un-churched" individuals to gain understanding of scriptures. Moreover, when new potential followers are investigating entry into a formal religion, they need to gain understanding of the Holy Bible and/or other foundational religious texts.

The Holy Bible is the best selling book in the world and studies have shown it is also a challenging book to read and comprehend. Christians and non-christians may not read the Holy Bible simply because they feel intimidated by the scriptures, feel that the scriptures are too difficult to understand, that topics which relate to a person's life are difficult to find, the messages contained with are contradictory and some may find that the Bible is boring. This presents a great challenge.

Notwithstanding, the religious book category was the only book category with triple-digit sales increases during the 1990's. During the past twelve years, one book series and three books have accounted for over 100 million books being sold. *The Left Behind* book series, which portrays fictional stories about what will happen if you do not have faith in God when the world ends, has sold over 59 million copies in the past twelve years. *The Purpose Driven Life*, a book that attempts to teach its readers how to do God's will for their life, has sold over 25 million copies and earned the title of the Best Selling Book in U.S. History. *The DaVinci Code* has become a movie with over 14 million copies of this book in print, and *The Prayer of Jabez*, has over 9 million books in print while showing God's plan for present blessings.

These books sales clearly demonstrate the fact that people are searching for something more than material possessions in their lives. Individuals appear to be searching for faith and an understanding of God in their lives. They are buying and reading books in an effort to satisfy his quest for an understanding of who God is and how to use their God given talents. This search by people seeking to know God personally is very real.

The quest for a better understanding and relationship with God crosses over between numerous religions. People are looking for meaning in their lives and they feel that having a close personal relationship with God may be the answer. These sales of 100 million books have created a true publishing phenomena. This landmark statistic deals directly with God, Spirituality, Religion, and Faith. Even more interesting is the fact that the majority of these book sales are fiction based.

While this trend may suggest that individuals are seeking a close personal relationship with God, it does not necessarily mean that these same individuals are taking their increased interest to the next step. Reading about God through fiction books and books which talk about identifying God in your life is entirely different from learning about God, through foundational religious texts, such as the Holy Bible.

This raises important questions: "How will individuals learn the teaching of the Holy Bible?"; "How will individuals learn to understand the meaning of foundational religious texts?"; "How do believers and non-believers begin to remove the stigma of the Holy Bible being a difficult to read and understand book?"; and "How can the knowledge contained in foundational religious texts be brought into context of today's society without intimidating people?".

Individuals may attend regular services lead by a spiritual leader of their faith and may also attend religious study groups that help to further their understanding of their faith's foundational religious texts. People may also be involved in doing missionary work and charity work to help individuals in need. These activities may or may not be supported by an affiliated religious organization.

Traditionally, these activities are associated with individuals who have a close personal relationship with other members of an affiliated religion. However, these same activities do not necessarily mean that the same individual possesses a close personal relationship with God or another spiritual embodiment. Actually, these activities do not necessarily mean that the individual knows how to identify God working in their lives.

While it is hoped that individuals involved with organized religion possess a close personal relationship with God, studies have shown that only 15% of these church attending members feel that they have a close relationship with God. Religion in today's society represents two distinct factions: those individuals who are involved in an organized religious group and those individuals who are not involved, but who may personally possess a dose personal relationship with God.

Studies show that attendance at organized religious services is declining. With decreased attendance comes a decline in collected funds used to do the works of religious organizations. President George W. Bush instituted the White House Office of Faith Based and Community Initiatives in 2001 which allows religious organizations access to government funding to do their work. President Bush's implementation of this office demonstrates his foresight into the ever-changing fiscal landscape of religious organizations.

Presidential Bush has shared his own personal faith with millions of people throughout the world on numerous occasions. By allowing his faith to become public he has stated that many of his most difficult decisions have been made after much thought, prayer, and with guidance from God. Many people believe that once a person comes to have a dose personal relationship with God, these individuals tend to look at life differently. These same people have relief in the belief that God does things in their lives when He feels they should be done.

The present invention has as its object increasing the ease with which scriptural texts, such as the Bible, may be understood despite their contextual setting from a time and place remote from everyday life today. The same is achieved using a two-books-in-one-spine format. In accordance with the invention, a non-fiction, biographical or auto-biographical book about a well-known individual, for example, is used as a vehicle to allow an individual to enter into an understanding of the Scripture. For example, a famous individual may share his life story in one part of the book. At the same time, relevant Scripture is quoted and intertwined on the same page as the biographical story. This may be done by way of a footnote or side note. At the same time references, for example by page, to actual scripture are contained in the same page that tells the modern-day story. Moreover, the modern-day lay story is bound on the same spine with the referenced scriptural work. In accordance with the invention, it is contemplated that the contents of the second corresponding book will be a foundational religious text, such as the Bible. This format will facilitate easy access to, and the establishment of, an understanding for foundational religious texts. All books developed under the confines of this invention will include:

The personal testimony of individuals who provide inspiration to, serve as mentors for, and whose own personal testimonies and lives assure believers and non-believers that their individual faith and commitment to God has helped guide them to become the person they are today.™

Individuals who possess deep faith in God live with an understanding of God, who He is and how He affects their life. Moreover, they trust God's wisdom. The Twelve Steps of Alcoholics Anonymous are based on an understanding that its members must connect with God. Step Three asks its members to turn their will and lives over to the care of God as we understand Him. Getting to the place in a person's life when they have his close, personal relationship with God takes time and often is accompanied by many personal trials and tribulations.

Johnny Cash is an example of a public figure who grew to have a close personal relationship with God. Throughout his career, he openly shared his Christian faith and relationship with God with millions of fans. Before coming to have a personal relationship with God, Johnny Cash lived a life filled with drugs and alcohol. This path in life left him destitute and incarcerated. Once "saved by God" he shared his belief in and understanding of God through his music, ministries and personal life.

Many worshipers want a close personal relationship with God, yet they are truly unable to identify the many miracles that God performs in their lives. Thus, they endeavor to do the good deeds which they feel God wants done. These routine actions are well-intentioned and describe an individual who is sharing of their faith. Performing acts which a person feels are "for God" is very different from actually possessing "faith in God" and "allowing God" to be in control of your life. Individuals, such as revolutionaries, understand and maintain this close, personal relationship with God.

Studies show that the majority of the American public claim to be "deeply spiritual" and their religious faith is "very important" to them. Yet these same studies show that only 15% of those individuals who attended church ranked their relationship with God as a top priority in their life. Pundits of organized religion use facts such as these to show just one of the many reasons why organized religion is on the decline. People expect more from their faith and from their own personal relationship with God. If they are not finding this in churches, temples, synagogues or other places of organized religion worship, they are seeking other means to find it. Another example, called a Religious Quest, is when a person who seriously searches for faith and spirituality bypasses organized religion, and conducts a search for a meaningful relationship with God on his or her own terms.

Individuals who are unhappy with their religious upbringing, and are looking for a deeper connection to a Higher Power, are called "Seekers" by demographic pollsters. These individuals are often well-educated, make a nice living, and want more from life than simple material things. Thus, the question becomes: "How can a religion, with an established doctrine, reach out to the millions of individuals who do not attend any formal institutional religious system, but who desperately want a dose personal relationship with God?"

Books described in the present invention will address, among other things, the needs of individuals searching for an understanding of how people identify God working in their lives. It is further believed that these books will help to eliminate the intimidation factor generally found with religious foundational texts, such as the Holy Bible.

By allowing the reader to read about the lives of well-known modern day individuals whose faith has helped guide them to become the people they are, the present invention will help people understand how to identify God working in their life. These same books described in the present invention are meant to help people say: "Now I understand", "Now I can identify God working in my life", and "Now I get it", in regards to identifying and subsequently having a close personal relationship with God.

By including selected scripture throughout the non-fiction, biographical and auto-biographical books configured in accordance with the invention, the reader will gain understanding and relevance of how foundational religious texts relate to an individual's life and society today. The selected scripture will depict similar scenarios, lessons, themes, etc. as portrayed in the nonfiction, biographical or autobiographical writings.

While hundreds of billions of dollars are devoted each year to the development of technologies for such things as achieving a fraction of one percent improvement in the operation of a gasoline engine, heating houses more uniformly, improving the speed of personal computers, and other such things, the improvement of people as self-motivated human beings of character and integrity as a part of society remains, in comparison, substantially untouched by technology, save for the largely counterproductive use of the media as a substitute for conventional entertainment.

This seems rather remarkable, given the importance of interpersonal reactions and relationships, and clear indicators in our society that at the turn-of-the-millennium the moral system has broken down, at the end of a century long cycle of decay. Compared to the state of moral affairs at the end of the last century, overall, there has been an increase in virtually every negative indicator of the moral health of a society. Divorces, births out of wedlock, abortions, murders, and all manner of psychological and physical violence, by and large, have risen steadily for the last hundred years.

Some have suggested that technology is the culprit. The logic behind is statement is not clear, but given the complexity of human development and reaction of human nature to various factors, there may be some truth to this. Perhaps, technology has created a world where our worst demons are nurtured and promoted. Nevertheless, despite the apparent value of technology as a tool, as alluded to above, it remains substantially untapped to address these problems. On the positive side, however, over the years, an attempt to improve people has been made by distributing the Holy Bible and other religious texts in hotel rooms.

Bibles, Torahs and Korans, and other religious foundational texts are traditionally printed and published in large quantities, due to the extensive and costly pre-press operations required to "prepare for the printing" of just one book. These traditional printing and publishing requirements do not lend themselves to the customization of Bibles, Torahs, Korans and other religious text, to be printed in customized small runs.

An embodiment of the present invention is one book, including two separate subject matters (essentially two books), joined together by one book spine. A first book is either a nonfiction, a biographical, or an autobiographical book and a second book is a foundational religious text which corresponds to the religious beliefs of the individual who is written about in the first book. The back covers of each are joined together, so that the book essentially has two front covers.

Once the nonfiction, biographical, or autobiographical book is opened and read, the reader will be able to reference how scripture and stories from the religious foundational text relate to the lives of people today. By bringing the scripture from the foundational religious text into the nonfiction, biographical or autobiographical book, readers will be able to understand how God can be present in the life of the person whose true story has been written.

By allowing the reader to reference scripture and stories from foundational religious text inside a nonfiction, biographical or autobiographical book and read about how these texts relate to a person's life, an understanding and relevance of these age-old scriptures will be brought to reality. In addition, referring to the passages from the religious foundational text will be easily accomplished, by simply turning the book over and continuing to read. This two-books-in-one format will bring the subject matter and relevance of the two books together, in content and by their book spine.

Figure 1:
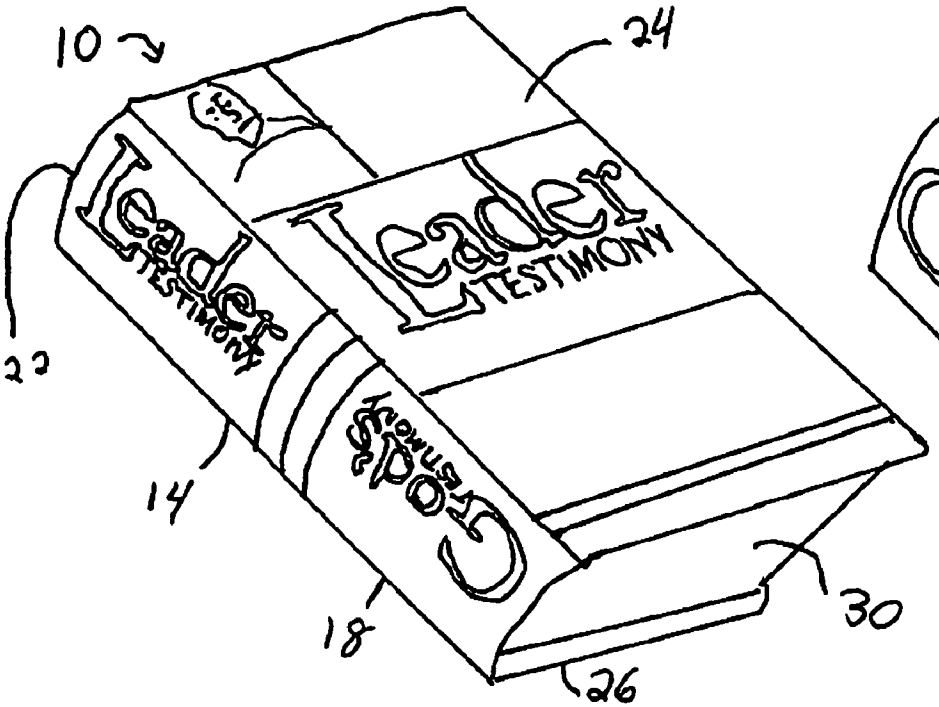
FIG. 1 is an example of an embodiment of the present invention.
Figure 3:
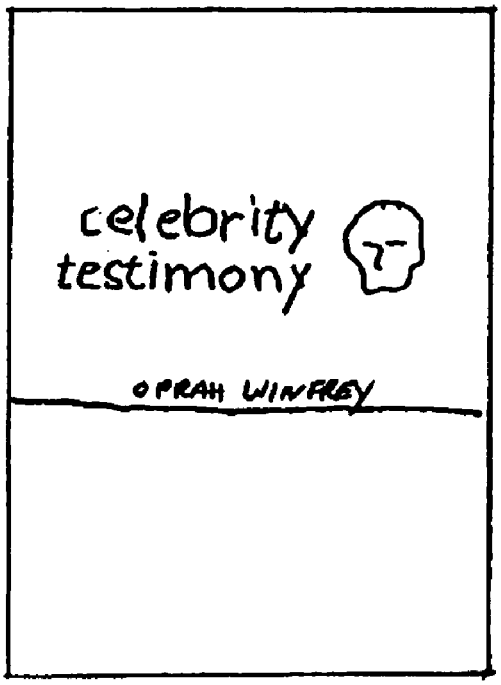
FIG. 3 is an example of a factual text used in conjunction with the present invention.
Figure 4:
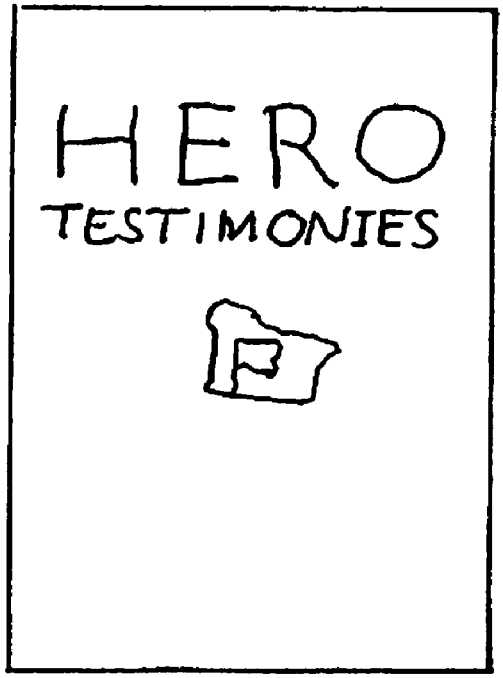
FIG. 4 is yet another example of a factual text.
Figure 5:
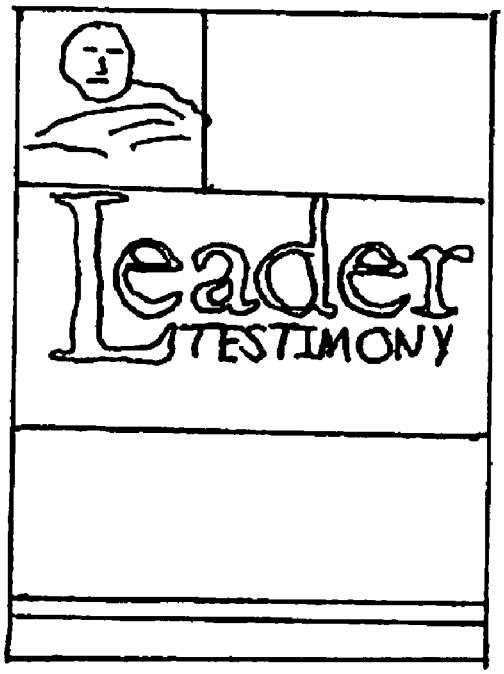
FIG. 5 is another example of a factual text.
Figure 6:
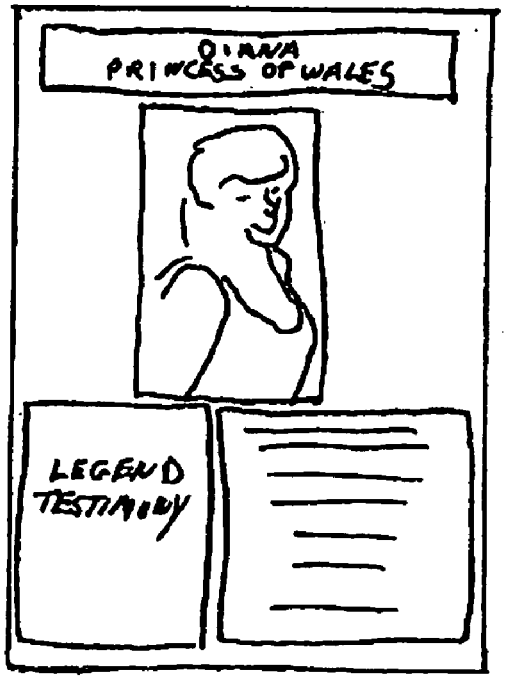
FIG. 6 is another example of a factual text.

As illustrated in FIG. 1, the present invention may take the form of a spiritual book 10 that incorporates two texts, one part is a religious text 18 and the other part is a biographical story 14. The first part and the second part are bound together with a single spine 22. The books are bound back to back, oriented in opposite directions vertically, so by flipping the book over each side can be viewed properly.

Book 10 includes a front cover 24 and a back cover 26 and a plurality of pages bound therebetween, for example by being secured to spine 22. Any binding technique may be used for the making of the book disclosed herein.

FIG. 2 illustrates book 10, after it has been flipped over from left to right and turned upside down. Thus, cover 26 is oriented upside down with respect to opposite cover 24.

When the inventive book 10 is oriented in the position shown in FIG. 1, cover 24 and at least pages 30 may be opened to reveal, for example, a cover page. The print on pages 30 is oriented the same way as the print on cover 24.

For example, one may be reading an inspiring story about a world leader. In accordance with the present invention, it is contemplated that the story of such a leader would inspire certain individuals. It is further contemplated that different individuals may require different role models and different examples of life stories which took advantage of strengths of character or overcame prejudices or problems on the road toward a successful life.

The inventive book 10 may be flipped and put in the position as shown in FIG. 2. As the book is opened, it will reveal a second text in this case, a religious text such as the Bible or any other religious text as mentioned above. This text may take the form of a chapter of the Bible if the inventive book is to have a particular focus, or the entire Bible can be bound with the lay biographical, autobiographical or fictional work.

FIGS. 3, 4, 5 and 6 are examples of non-fictional text covers that may be used in embodiments of the present invention.

FIGS. 7, 8, 9 and 10 are examples of pages from the inside of an embodiment of the present invention. FIG. 7 is a page from The First Book of Moses, called Genesis, Chapter 1. This page is an example of a page that would be in the spiritual text of the book. FIG. 8 is a page from a biography of Marilyn Monroe, which would be an example of a page in the non-fictional or biographical text of the book. FIGS. 9 and 10 are examples of both FIGS. 7 and 8 being incorporated into one page. This is an example of a biographical text of Marilyn Monroe along with a spiritual text excerpt at the top from the First Book of Moses.

Alternative and preferred embodiments of the present invention particularly adapted for those who are uncomfortable trying to comprehend and put relevance into philosophical and ethical texts, for example the biblical scriptures contained in The Holy Bible, are illustrated in FIGS. 11-18. The structural format of the same is configured to easily transfer the wisdom in the stories of the Holy Bible.

Rather than trying to read the bible beginning at page one, the same provide an alternative intellectually user friendly entry into an understanding of the texts, notwithstanding the many unique names and locations, with hard to pronounce geographic areas, which tend to frustrate and thwart the biblical reader from comprehension. the result is to prevent the reader from feeling ignorant, with which many find it difficult to deal.

The invention contemplates a bible that uses well-known books, to teach lessons from the Holy Bible. Lessons shared in a well-known spiritual, ethical, biographical or other book, are referenced to similar stories in the Holy Bible. Moreover, these stories are shared in the context of the Bible itself. Readers are thus allowed to see how the lessons contained in an everyday book could relate to similar lessons shared in the Holy Bible.

The inventive Bibles contain two books (a lay text and a Bible) in one-book-spine format. In accordance with one embodiment, well-known books that have a spiritual foundation in their message are employed. As the use reads the lay text, the user sees footnotes in the main body text. Each footnote is preferably located on the same page and refers the reader to the scriptural reference quotation on the side of the page. In the Scriptural Reference Section the reader is encouraged to read more of the scripture that teaches the lesson from the corresponding Holy Bible.

As the reader reads footnoted scriptures from the Scriptural Reference Section, the reader then has the ability to continue reading that biblical scripture by flipping over this book and going to the page referenced in the footnote. References are also made to related biblical text sections.

Allowing readers the ability to read biblical scripture from a Holy Bible and be shown how it relates to other scriptural works will increase a reader's comprehension of time-honored biblical scripture. Studies show that many people own bibles, few are reading them frequently. The Holy Bible is believed to be too hard to understand, too long, contain contradictory messages, and largely boring. in accordance with the invention, his is addressed by allowing the reader to immediately continue to read referenced scripture and beyond.

As illustrated in FIGS. 11-14, the present invention may take the form of a spiritual book 110 that incorporates two books bound to a single spine 111, each with its own text. One book part 112 is a religious book part with a religious text 114 and the other book part is a lay biographical book part 116 with a lay text 118. The first book part and the second book part are bound together with a single spine 111, back to back, oriented in opposite directions vertically. By flipping the book 110 about the spine 111 each side can be viewed properly.

Book 110 includes a front cover 120 and a back cover 122 and a plurality of pages 124 bound therebetween, for example, by being secured to spine 111. Any binding technique may be used for the manufacture of book 110 disclosed herein.

Figure 12:
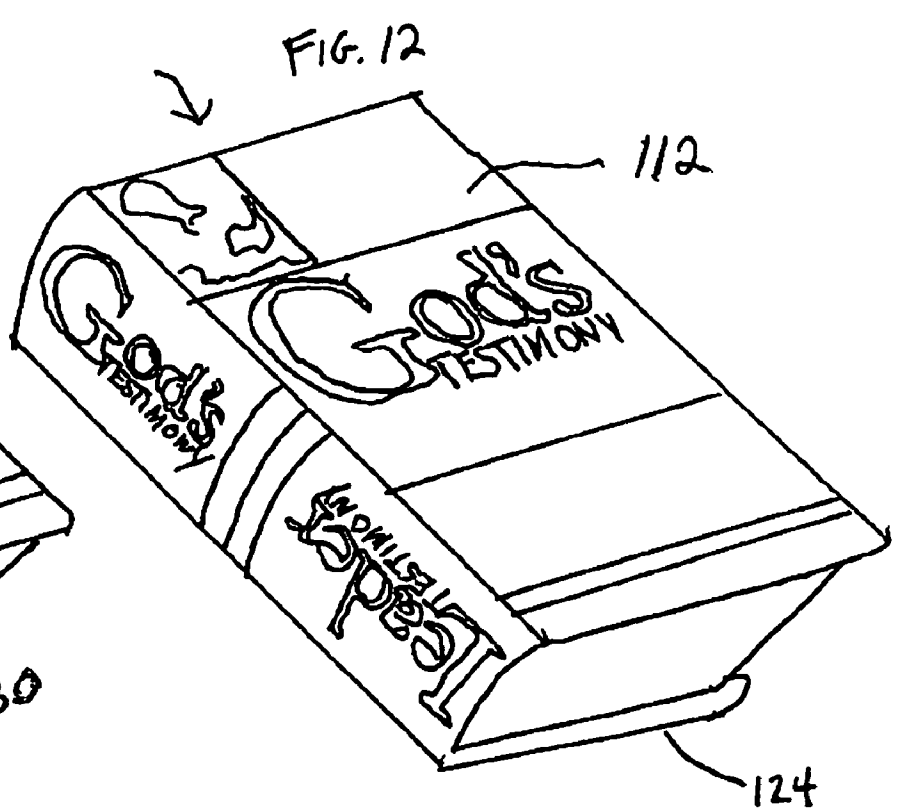
FIG. 12 is a view of the book of FIG. 11 flipped over and reoriented to be readable.

FIG. 12 further illustrates book 110, after it has been Flipped over from left to right and turned upside down. Thus, cover 120 is oriented upside down with respect to opposite cover 122.

Figure 11:
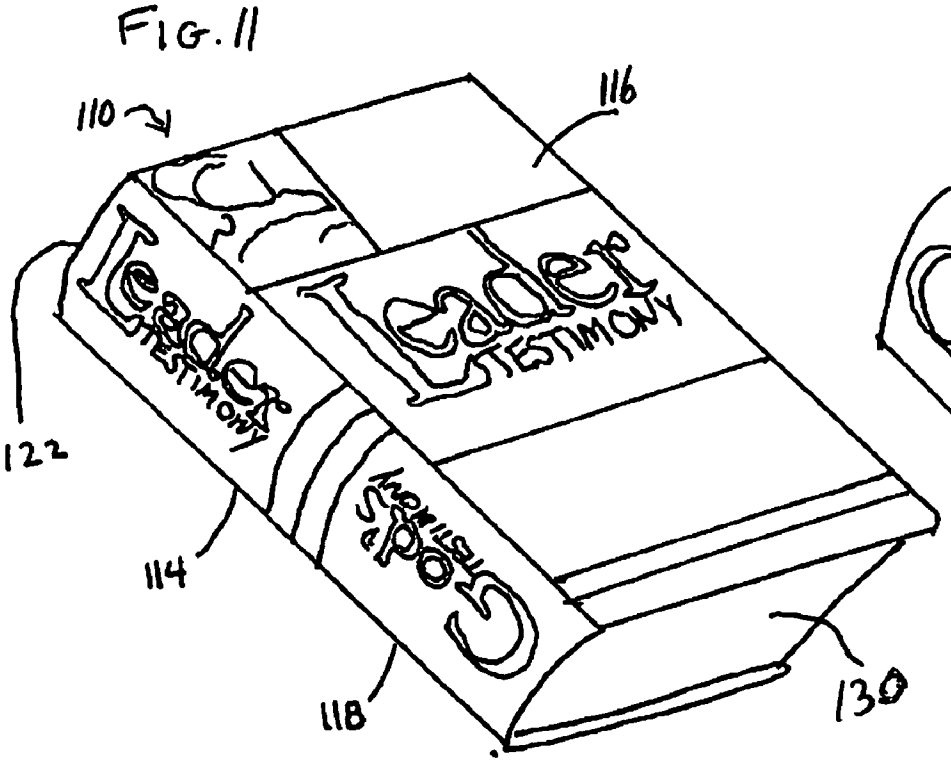
FIG. 11 is an alternative embodiment of the invention.
Figure 14:
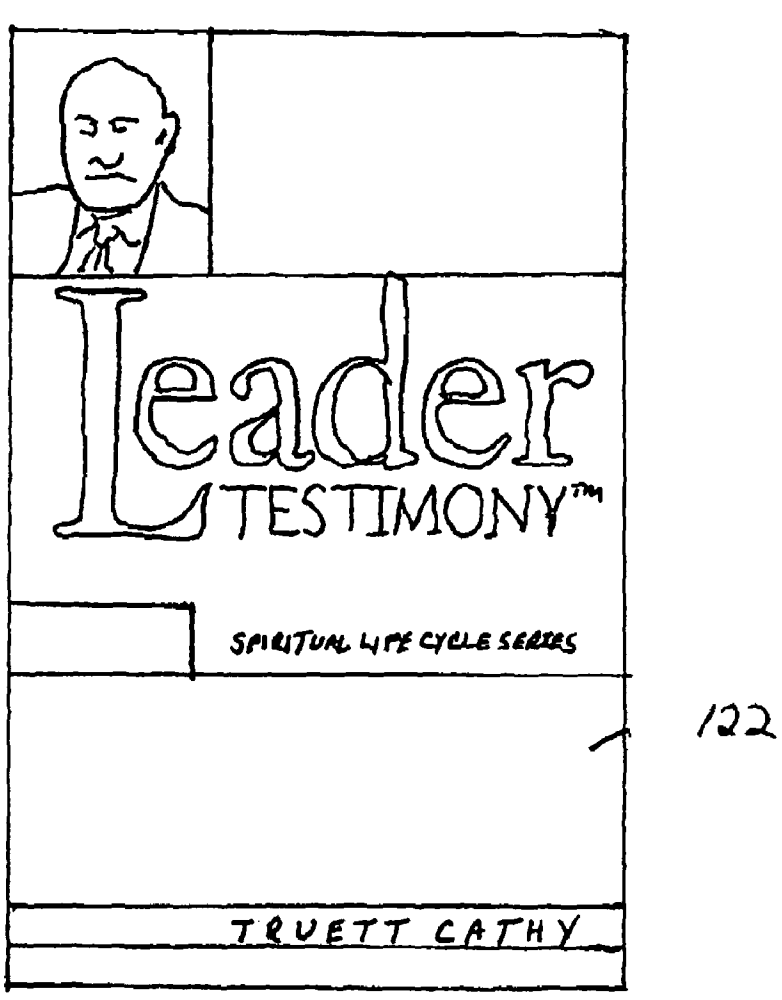
FIG. 14 is a view of the cover of the book as illustrated in FIGS. 12.
Figure 13:
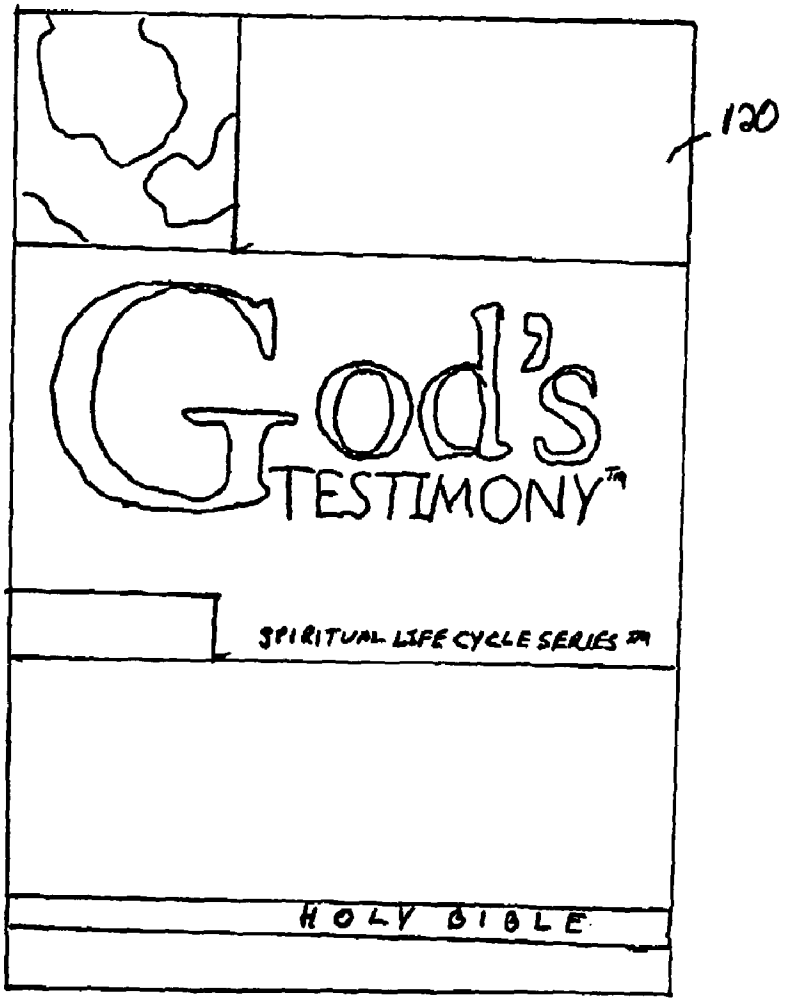
FIG. 13 is a view of the cover of the book as illustrated in FIGS. 12.
Figure 18:
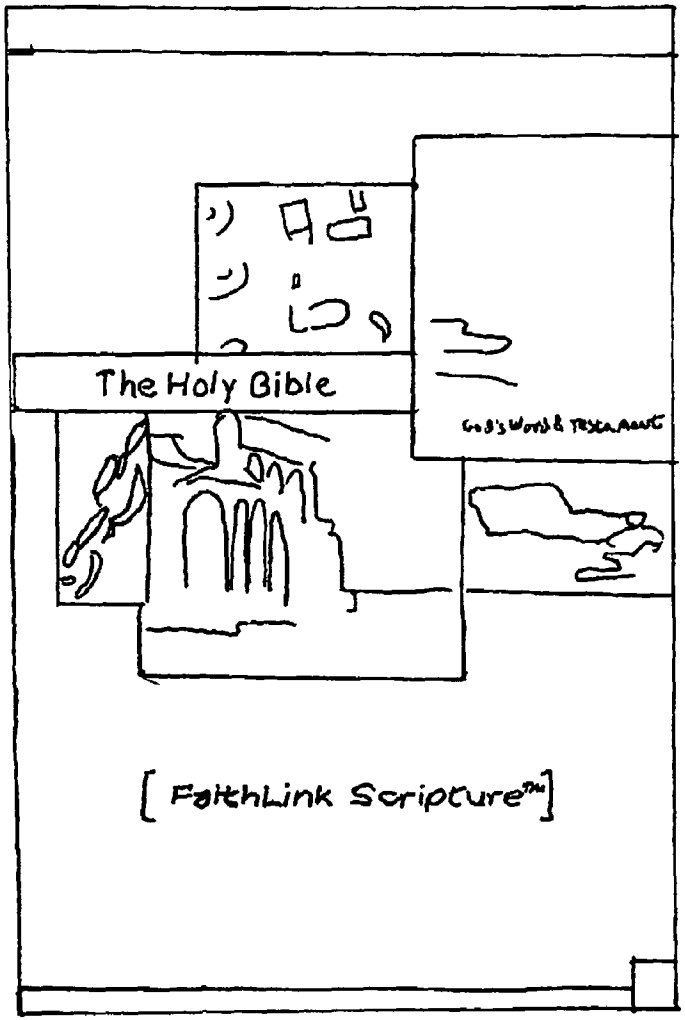
Figure 17:
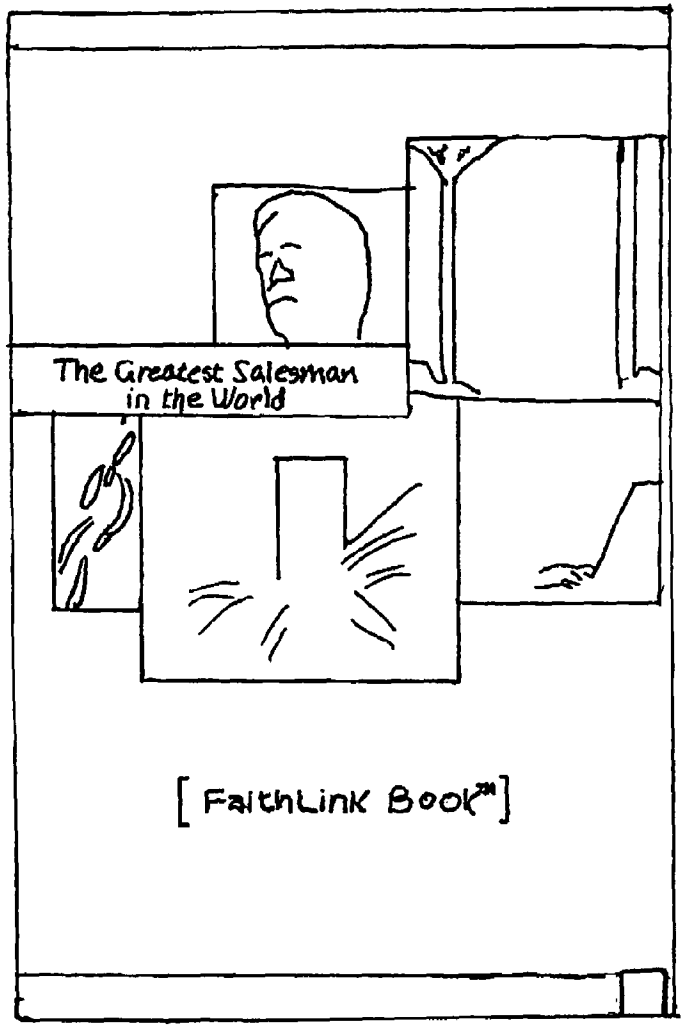

When the inventive book 110 is oriented in the position shown in FIG. 11, cover 116 and at least page 126 may read, because the print on page 126 is oriented the same way as print on cover 120. The text 118 on page 126 constitutes a biographical story, meant to inspire ethical values.

FIG. 12 illustrates the present invention with the spiritual book part 112 exposed. Book part 112 incorporates a second text 114 on a page 128, which is religious text 114 disposed on page 126, which may constitute part of a complete Bible making up book part 112. As noted above, book parts 112 and 116 are bound together with a single spine 111. The book parts are bound back to back, oriented in opposite direction vertically. By flipping the book over each side can be viewed properly.

Referring to FIG. 15, text 118 mentions a concept 130, in this case "opportunities". This concept is given a footnote or sidenote 132 which keys out with a sidenote 134 located in a segmented portion 136 of the page 128, for example on the side of the page. Sidenote 134 ends with a page reference 136, which refers to a page 126 (FIG. 16) in religious book part in 112.

FIGS. 17-20 illustrate a substantially identical concept applied to a book 210 with a fictional book part 212 and a scriptural book part 214. Fictional book part to 212 includes a fictional text 216 (FIG. 19), including a footnoted religious concept 218 and a corresponding footnote or sidenote reference 220, and a sidenote 222. The footnote ends with a reference 224 to a page in the Bible. This page is contained in scriptural book part 214 and is illustrated in FIG. 20.

While the present invention and its embodiments have been described in detail, it will be apparent to those skilled in the art that the principles of the invention are readily adaptable to other implementations and system configurations and communications paradigms without departing from the scope and spirit of the invention, as defined by the following claims.

The invention claimed is:

1. A book for educating and instilling moral values in an individual, comprising a first set of text groupings having philosophical content selected from a classical philosophical text, said classical philosophical text being known to the individual to be educated and instilled with moral values, said first set of text groupings comprising a first physical background material and a first physical text material contrasting optically with said first physical background material, a second set of text groupings having biographical content selected from a life experience of a personality or personalities who may serve as a role model for said individual to be educated and instilled with moral values, said personality or personalities being known to said individual to be educated and instilled with moral values, said a second set of text groupings comprising a second physical background material and a second physical text material contrasting optically with said second physical background material, said second set of text groupings comprising referencing information referencing to specific portions of said content selected from said classical philosophical text, said referencing information being located proximate to information in said second set of text groupings related to the content of said referenced specific portions of said content selected from said classical philosophical text, said first set of text groupings being bound to said second set of text groupings to form a unified work, whereby an individual to be educated and instilled with moral values reading said second set of text groupings reads said referencing information referencing to said specific portions of said content selected from said classical philosophical text, whereby said individual to be educated and instilled with moral values addresses his or her attention to and reads said specific portions of said content selected from said classical philosophical text contained in said first set of text groupings, and wherein said first and second physical background materials are bound into first and second sets of pages, respectively, said first and second sets of pages being bound into a book with two covers, and with orientations such that said first set of pages comprises a first cover oriented in a conventional manner with the spine on the left when said book is positioned with said first cover exposed, and said second set of pages comprises a second cover oriented in said conventional manner with the spine on the left when said book is positioned with said second cover exposed, said first and second sets of pages being secured to each other at the spine with said first and second covers exposed.

2. A book as in claim 1, wherein said philosophical text is the Bible.

3. A book as in claim 1 wherein the second set of text groupings relate the life of a prominent figure known to the public.

4. A book as in claim 1, wherein said first and second sets of text groupings are determined in response to a customer input.

5. A book as in claim 4, wherein said classical philosophical text is composed of the entire text of the Bible, the Torah, and other pertinent religious texts together with numerous types and examples of illustrations, lessons and commentary associated with various parts of the Bible or said religious texts and available for selection by said customer.

6. A book as in claim 5, wherein said religious text is composed of passages which are selected by said customer and emphasized by highlighting or the like for the intended recipient.

7. A book as in claim 6, wherein said selected passages are emphasized for the intended recipient by highlighting, underlining, or or other visual modification.

8. A book as in claim 5, further comprising a personalized message with sections emphasized which relate to said individual's age and problems.

9. A book as in claim 8, further comprising personal information and illustrations, and/or a photograph.

10. A book as in claim 1, wherein said referencing information communicates the location in said first set of text groupings of said specific portions of said content selected from said classical philosophical text.

11. A method of educating and instilling moral values in an individual comprising:

(a) creating a first set of text groupings having philosophical content selected from a classical philosophical text, said classical philosophical text being known to the individual to be educated and instilled with moral values, said first set of text groupings being arranged in a first set of pages comprising a first cover;

(b) creating a second set of text groupings having biographical content selected from a life experience of a personality or personalities who may serve as a role model for said individual to be educated and instilled with moral values, said personality or personalities being known to said individual to be educated and instilled with moral values, said second set of text groupings being arranged in a second set of pages comprising a second cover;

(c) said second set of text groupings being created with referencing information referencing to specific portions of said content selected from said classical philosophical text, said referencing information being located proximate to information in said second set of pages related to the content of said referenced specific portions of said content selected from said classical philosophical text;

(d) physically associating said first set of text groupings on said first set of pages to said second set of text groupings on said second set of pages, said first set of pages and said second set of pages to forming a unitary work;

(e) providing said unitary work to said individual to be educated and instilled with moral values;

(f) said individual to be educated and instilled with moral values reading said second set of text groupings;

(g) said individual to be educated and instilled with moral values reading said referencing information referencing to said specific portions of said content selected from said classical philosophical text, wherein said first and second sets of pages are physically coupled to each other to form first and second sets of pages, said first set of pages, said first cover and said first set of text groupings when accessed being oriented in a conventional manner with the spine on the left, and said second set of pages, said second cover and said second set of text groupings when accessed being oriented in a conventional manner with the spine on the left;

(h) said individual to be educated and instilled with moral values addressing his or her attention to and reading said specific portions of said content selected from said classical philosophical text contained in said second set of text groupings, whereby said individual is educated and instilled with a moral value.

* * * * *